US010228130B2

(12) United States Patent
Wilson

(10) Patent No.: US 10,228,130 B2
(45) Date of Patent: Mar. 12, 2019

(54) PORTABLE FLARE

(71) Applicant: Burlington Welding LLC, Cherokee, OK (US)

(72) Inventor: Robert Leroy Wilson, Cherokee, OK (US)

( * ) Notice: Subject to any disclaimer, the term of this patent is extended or adjusted under 35 U.S.C. 154(b) by 447 days.

(21) Appl. No.: 14/535,260

(22) Filed: Nov. 6, 2014

(65) Prior Publication Data

US 2015/0176839 A1 Jun. 25, 2015

Related U.S. Application Data

(60) Provisional application No. 61/900,977, filed on Nov. 6, 2013, provisional application No. 61/982,835, filed on Apr. 22, 2014.

(51) Int. Cl.
*F23G 7/00* (2006.01)
*F23G 7/08* (2006.01)
*F23G 5/50* (2006.01)

(52) U.S. Cl.
CPC ..... *F23G 7/085* (2013.01); *F23G 5/50* (2013.01); *F23G 2203/60* (2013.01)

(58) Field of Classification Search
CPC ..... E21B 41/0071
USPC ..... 431/193, 202, 253
See application file for complete search history.

(56) References Cited

U.S. PATENT DOCUMENTS 4,025,281 A * 5/1977 Lapp ..... F23G 7/085 422/173
4,139,339 A * 2/1979 Straitz, III ..... F23G 5/50 422/168
4,431,402 A * 2/1984 Hamilton ..... F23G 7/08 431/202
5,601,040 A * 2/1997 McGill ..... F23G 5/008 110/215
6,431,855 B1 * 8/2002 Pedersen ..... E21B 41/0071 431/202
2008/0185813 A1 * 8/2008 Watson ..... E21B 41/0071 280/404
2012/0015308 A1 * 1/2012 Hong ..... F23G 5/50 431/5
2014/0272739 A1 * 9/2014 Hurley ..... B01D 45/08 431/253
2014/0366577 A1 * 12/2014 Zubrin ..... H04W 76/10 62/619

FOREIGN PATENT DOCUMENTS

CA 2531462 A1 * 6/2006

* cited by examiner

*Primary Examiner* — Nina Bhat
(74) *Attorney, Agent, or Firm* — Martin S. High, P.C.

(57) ABSTRACT

This is a transportable forced air elevated flare with a better than 98% burn efficiency. This is all built on a trailer to be able to move quickly to different locations. The unit is self-contained and can be quickly setup and put in operation without the use of cranes or other heavy equipment. The unit is also able to carry steel pipe and different types of hoses to allow this unit to tie to tank batteries or well heads.

2 Claims, 2 Drawing Sheets

PORTABLE FLARE

CROSS-REFERENCE TO RELATED APPLICATIONS

This application is a non-provisional patent application of U.S. provisional patent application with Ser. No. 61/900,997 titled "Portable Flare" filed on Nov. 6, 2013. This application claims priority of U.S. provisional patent application with Ser. No. 61/900,997. Further, the entire contents of U.S. provisional patent application with Ser. No. 61/900,997 are herein incorporated by reference.

This application is a non-provisional patent application of U.S. provisional patent application with Ser. No. 61/982,835 titled "Portable Flare" filed on Apr. 22, 2014. This application claims priority of U.S. provisional patent application with Ser. No. 61/982,835. Further, the entire contents of U.S. provisional patent application with Ser. No. 61/982,835 are herein incorporated by reference.

STATEMENT REGARDING FEDERALLY SPONSORED RESEARCH OR DEVELOPMENT

Not applicable

FIELD OF THE EMBODIMENTS

The field of the embodiments is oil field equipment, specifically oil field gas flares.

BACKGROUND OF THE EMBODIMENTS

The background of the embodiments involves the design of a portable flare.

SUMMARY OF THE EMBODIMENTS

This is a transportable forced air elevated Flare with a better than 98% burn efficiency. This is all built on a trailer to be able to move quickly to different locations. The unit is self-contained and can be quickly setup and put in operation without the use of cranes or other heavy equipment. The unit is also able to carry steel pipe and different types of hoses to allow this unit to tie to tank batteries or well heads.

DETAILED DESCRIPTION OF THE PREFERRED EMBODIMENTS

Figure 1:
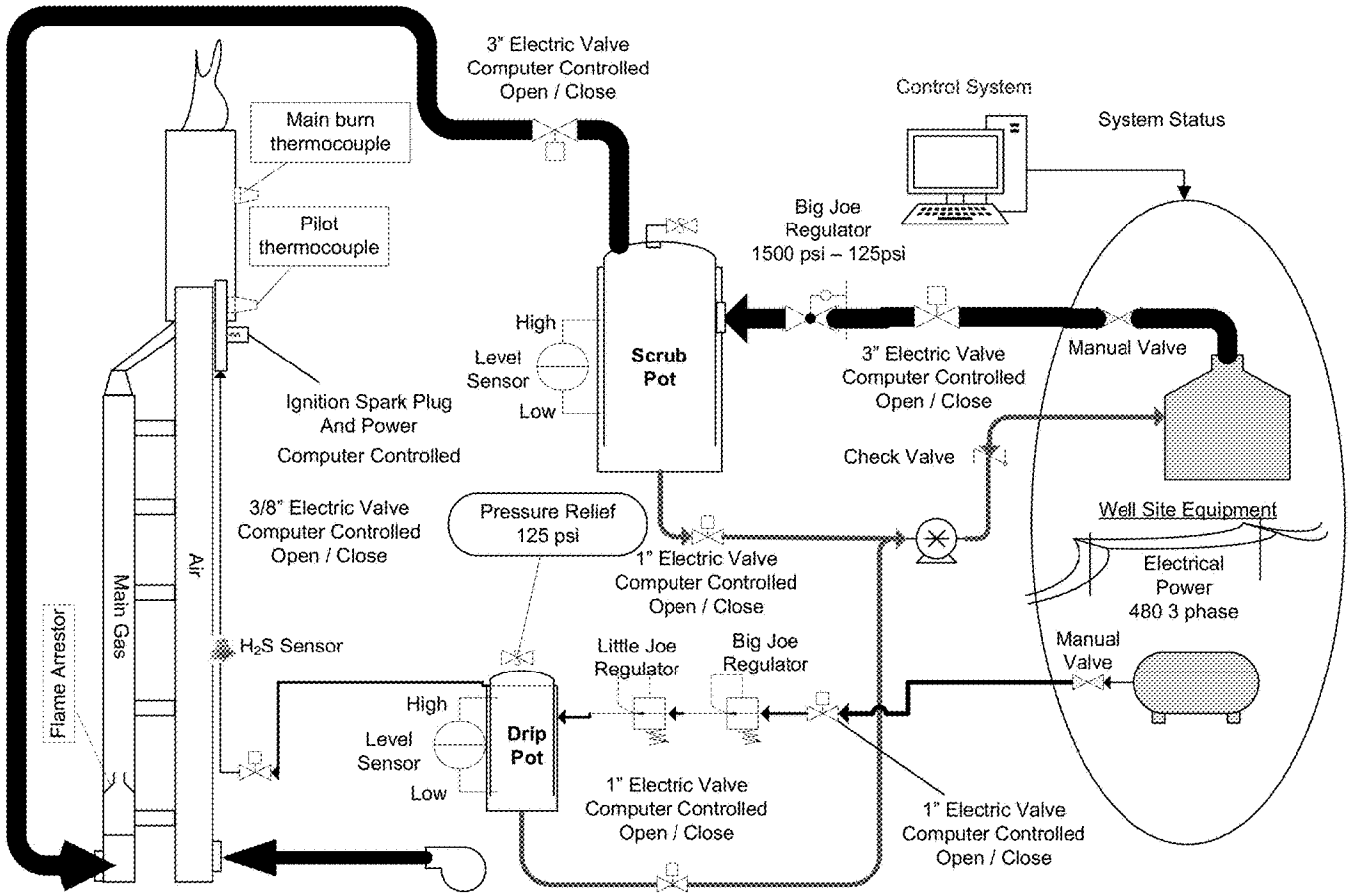
FIG. 1 is a schematic view of the Portable Flare.
Figure 2:
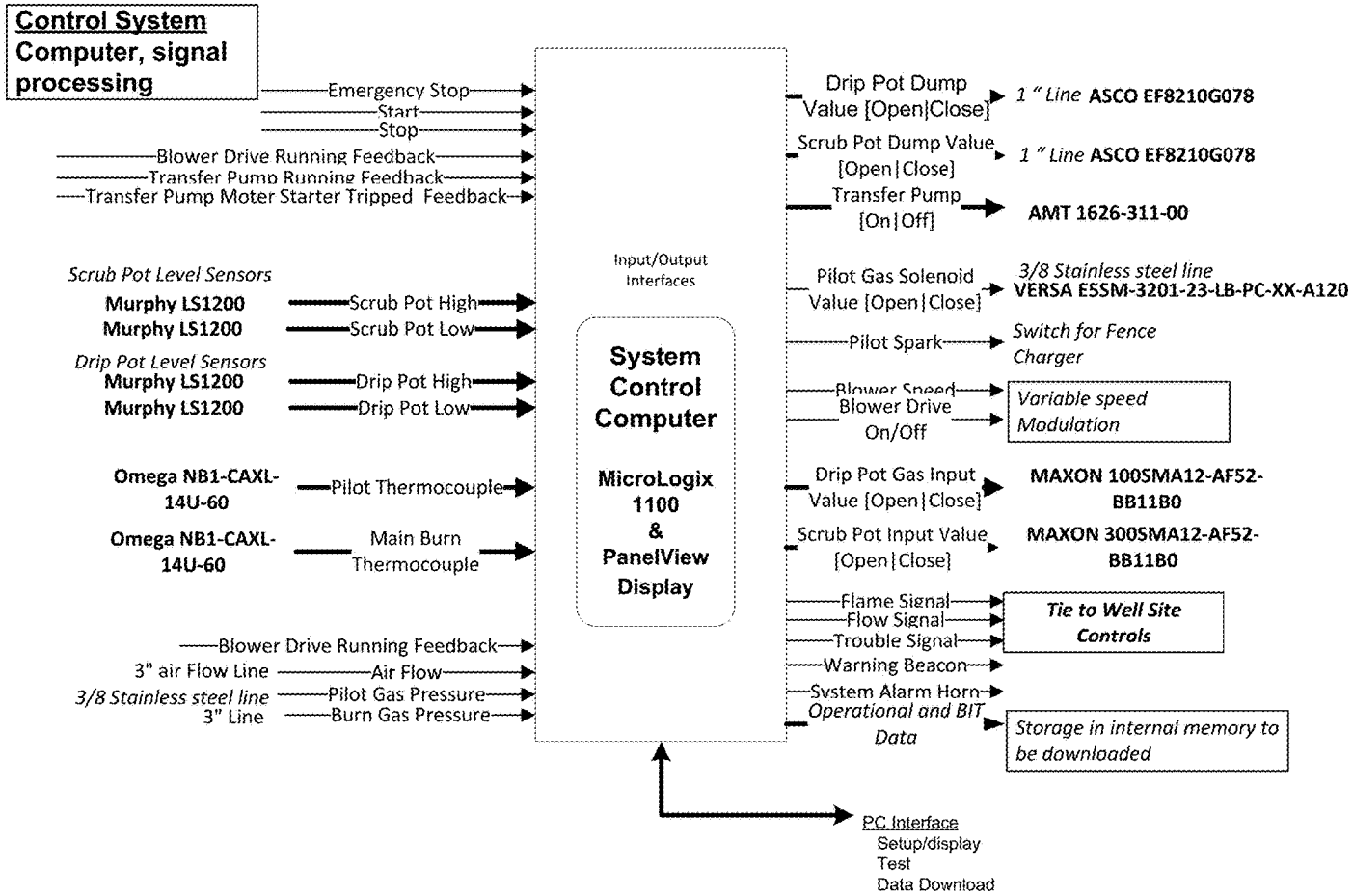
FIG. 2 is a schematic view of the control system for the Portable Flare.

A preferred embodiment of the Portable Flare 100 is comprised of a pilot light assembly, a transport assembly, an air tube, a gas tube, a blower, an air flow control means, a spark assembly, a flame tube, a control unit, and a hydraulic lift.

The pilot gas comes from the well site scrub pot or knockout tank thru a 1" line. The flare pipe controls a valve to turn on and off the pilot gas to the flare. The pilot gas goes to a regulator taking pressure from 1500 psi down to 500 psi. This is then further reduced down to 125 psi with a second stage regulator. The pilot gas exits the drip pot through a ⅜" stainless steel line via an electric solenoid for on and off control. A regulator in the ⅜" line reduces the pressure down to ounces. The pilot gas then enters a ½" pipe running up the side of the flare pipe to a burner. The pilot gas is ignited by a continuously sparking champion 200 spark plug. The pilot flame goes into an elbow which turns the flame across to the main outlet of gas and air to be burnt off.

The burn gas comes from the well site storage tanks thru a 2" line connected to the flare pipe. The flare pipe controls a valve to turn on and off the burn gas to the flare. The first stage regulator will protect the flare pipe by reducing the burn gas pressure to 125 psi. This is to prevent a blowout from two much well head pressure. This pipe reduces down to a 2" pipe which drops the burn gas into the 3" air flow pipe and mixes the burn gas and air for a cleaner burn. Then this mixture of air and gas is ignited by the pilot flame then is burnt off inside the burn tube. The burn tube keeps the gas and air together for a clean burn. The burn tube is 6 ft. long and 8 inches in diameter and has air inlets to create a venturi effect to pull in additional assist air.

The air for the assist air flow is pulled from the environment and blown up the air tube. The clean burn is made possible with the injection of air to produce a hotter flame. The temperature of the flame is controlled by monitoring the flame temperature and adjusting the forced air flow with a blower fan forcing air up the air tube to mix with the burn gas. The hydraulic lift is comprised of a hydraulically actuated means to raise the air tube from the transportable position to the operating position.

The flare pipe control system consists of relays, timers associated equipment to monitor key operating parameters to assure proper gas flow through the system and the appropriate conditions for thermal destruction of the combustible pollutants. The key operating parameters to monitor are: a) Flame presence, based on temperature readings at the pilot and burn tube; and temperature at flare and combustion zone;

The trailer consists of a custom made DOT approve trailer with the flare system built on it.

What is claimed is:

1. A portable flare comprised of a transport assembly, an air tube, a gas tube, a blower, a spark assembly, a flame tube, flare pipe control system comprising monitoring temperatures of a pilot, a burn tube, flare zone, a hydraulic lift, and combustion zone; wherein the transport assembly is comprised of a DOT approved trailer upon which the flair system is mounted; wherein the air tube is positioned vertically; wherein the blower pulls air from the environment and blows the air into the air tube; wherein the flame tube is located above both the gas and air tube; flare pipe control system monitors temperatures of a pilot, a burn tube, flare zone, and combustion zone and controls pilot gas solenoid; wherein pilot gas is drawn from the well site scrub pot or knockout tank; wherein the flare pipe control system actuates a valve to turn on and off the pilot gas to the flare; wherein the pilot gas pressure is reduced to 500 psi via a first regulator, and then further to 125 psi via a second regulator.

2. The portable flare described in claim 1 wherein the control system consists of relays, timers associated equipment to monitor key operating parameters to assure proper gas flow through the system thereby providing conditions for thermal destruction of the combustible pollutants.

* * * * *